US009555531B2

(12) United States Patent
Moore

(10) Patent No.: US 9,555,531 B2
(45) Date of Patent: Jan. 31, 2017

(54) HYDRAULIC HAMMER HAVING CO-AXIAL ACCUMULATOR AND PISTON

(71) Applicant: CATERPILLAR INC., Peoria, IL (US)

(72) Inventor: Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 984 days.

(21) Appl. No.: 13/837,969

(22) Filed: Mar. 15, 2013

(65) Prior Publication Data

US 2014/0262406 A1 Sep. 18, 2014

(51) Int. Cl.

*B25D 9/14* (2006.01)
*B25D 9/18* (2006.01)
*B25D 9/20* (2006.01)

(52) U.S. Cl.

CPC ..... *B25D 9/145* (2013.01); *B25D 9/18* (2013.01); *B25D 9/20* (2013.01); *B25D 2209/005* (2013.01); *B25D 2250/225* (2013.01); *B25D 2250/231* (2013.01); *B25D 2250/245* (2013.01); *B25D 2250/365* (2013.01)

(58) Field of Classification Search

CPC ..... B25D 9/145; B25D 9/18; B25D 9/20; B25D 2250/231; B25D 2209/005

See application file for complete search history.

(56) References Cited

U.S. PATENT DOCUMENTS 3,490,549 A * 1/1970 Catterson ..... B25D 9/12 173/105
3,739,863 A * 6/1973 Wohlwend ..... B25D 9/145 173/204
3,754,396 A 8/1973 Erma
3,853,036 A 12/1974 Eskridge et al.
3,991,655 A 11/1976 Bouyoucos et al.
4,011,795 A 3/1977 Barthe et al.
4,181,183 A * 1/1980 Okada ..... B25D 9/145 173/204
4,261,249 A 4/1981 Grantmyre
4,264,107 A * 4/1981 Janach ..... B25D 9/12 173/204
5,052,498 A * 10/1991 Gustafsson ..... B25D 11/125 173/118
5,174,386 A * 12/1992 Crover ..... E02D 7/06 173/129

(Continued)

FOREIGN PATENT DOCUMENTS

DE 100003415 11/2001
EP 0127885 12/1984

(Continued)

OTHER PUBLICATIONS

U.S. Patent Application of Cody Moore, entitled "Hydraulic Hammer Having Impact System Subassembly" filed Mar. 15, 2013.

(Continued)

*Primary Examiner* — Andrew M Tecco
(74) *Attorney, Agent, or Firm* — Finnegan, Henderson, Farabow, Garrett & Dunner, LLP

(57) ABSTRACT

A hydraulic hammer is disclosed having a piston and an accumulator membrane disposed external and co-axial to the piston. Additionally, a sleeve is disposed between the piston and accumulator membrane, wherein the sleeve has a plurality of radial passages formed therein that fluidly connect the accumulator membrane with the piston.

6 Claims, 6 Drawing Sheets

(56) References Cited

U.S. PATENT DOCUMENTS

| | | | | |
|---|---|---|---|---|
| 6,073,706 | A | 6/2000 | Niemi | |
| 6,105,686 | A * | 8/2000 | Niemi | B25D 9/145 173/204 |
| 7,156,190 | B2 * | 1/2007 | Ottestad | B25D 9/12 173/128 |
| 8,733,468 | B2 * | 5/2014 | Teipel | B25D 9/12 173/135 |
| 2003/0006052 | A1 | 1/2003 | Campbell, Jr. | |
| 2012/0138328 | A1 * | 6/2012 | Teipel | B25D 9/12 173/207 |
| 2014/0020920 | A1 * | 1/2014 | Tang | B25D 9/145 173/90 |

FOREIGN PATENT DOCUMENTS

| | | |
|---|---|---|
| EP | 0 933 169 A2 | 1/1999 |
| GB | 1480903 | 4/1973 |
| WO | WO 2004/020155 A1 | 3/2004 |

OTHER PUBLICATIONS

U.S. Patent Application of Cody Moore, entitled "Accumulator Membrane for a Hydraulic Hammer" filed Mar. 15, 2013.

* cited by examiner

HYDRAULIC HAMMER HAVING CO-AXIAL ACCUMULATOR AND PISTON

TECHNICAL FIELD

The present disclosure is directed to a hydraulic hammer and, more particularly, to a hydraulic hammer having a co-axial accumulator and piston.

BACKGROUND

Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid is then supplied to the hammer to drive a reciprocating piston and a work tool in contact with the piston.

The piston is usually included within an impact system that is surrounded and protected by an outer housing. A valve controls fluid to and away from the piston, and an accumulator provides a reservoir of the fluid at the valve. One or more passages connect the valve with the accumulator.

U.S. Pat. No. 3,853,036 (the '036 patent) that issued to Eskridge et al. on Dec. 10, 1974, discloses an exemplary hydraulic hammer. The hammer of the '036 patent includes a piston reciprocally located within an outer housing. An intake fluid reservoir and an outlet fluid reservoir are disposed around a valve at an axial end of the piston, wherein the fluid reservoirs form an accumulator. A plurality of long flow passages connects the valve with the fluid reservoirs to displace the piston.

Although perhaps suitable for some applications, the hammer of the '036 patent may have drawbacks. In particular, the long passages of the '036 patent may increase the time for fluid flow within the hydraulic hammer. Such an increased time for fluid transfer may result in delayed responses of the system. For example, a delay may occur between the time the system is activated and the piston is driven forward against the work tool, resulting in reduced efficiency.

The disclosed system is directed to overcoming one or more of the problems set forth above and/or other problems of the prior art.

SUMMARY

In one aspect, the present disclosure is directed to a hydraulic hammer assembly, the hydraulic hammer assembly may include a piston, an accumulator membrane, and a sleeve. The accumulator membrane may be disposed external and co-axial to the piston, and the sleeve may be disposed between the piston and the accumulator membrane. Additionally, the sleeve may have a plurality of radial passages formed therein that fluidly connect the accumulator membrane with the piston.

In another aspect, the present disclosure is directed to a method of operating a hydraulic hammer. The method may include receiving pressurized fluid at an inlet and directing the pressurized fluid axially into an accumulator membrane. Additionally, the method may include redirecting the pressurized fluid radially inward from the accumulator membrane toward a piston and biasing the piston upward with the pressurized fluid.

DETAILED DESCRIPTION

Figure 1:
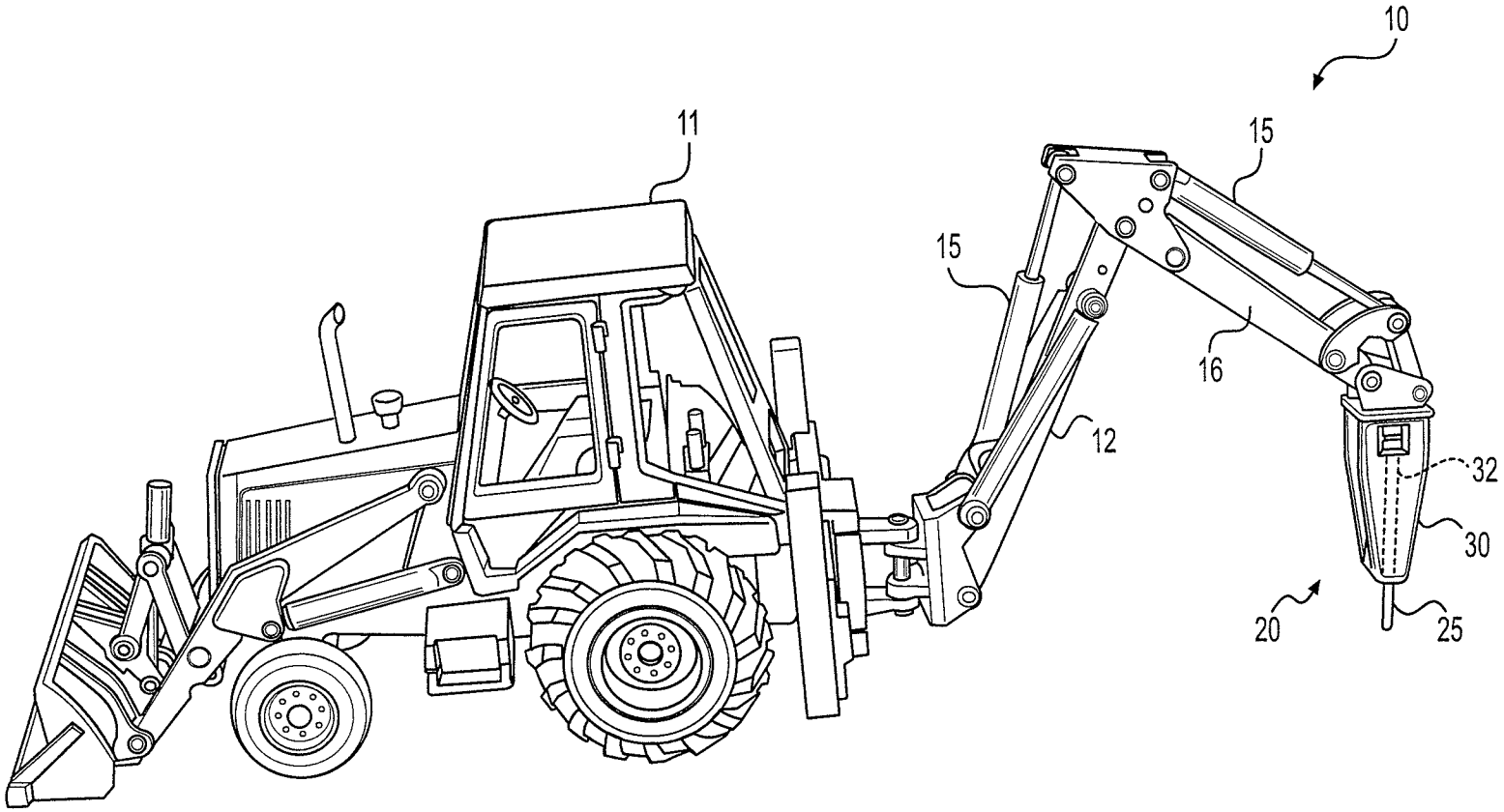
FIG. 1 is a diagrammatic illustration of an exemplary disclosed machine.

FIG. 1 illustrates an exemplary disclosed machine 10 having a hammer 20. Machine 10 may be configured to perform work associated with a particular industry such as, for example, mining or construction. For example, machine 10 may be a backhoe loader (shown in FIG. 1), an excavator, a skid steer loader, or any other machine. Hammer 20 may be pivotally connected to machine 10 through a boom 12 and a stick 16. It is contemplated that another linkage arrangement may alternatively be utilized, if desired.

In the disclosed embodiment, one or more hydraulic cylinders 15 may raise, lower, and/or swing boom 12 and stick 16 to correspondingly raise, lower, and/or swing hammer 20. The hydraulic cylinders 15 may be connected to a hydraulic supply system (not shown) within machine 10. Specifically, machine 10 may include a pump (not shown) connected to hydraulic cylinders 15 and to hammer 20 through one or more hydraulic supply lines (not shown). The hydraulic supply system may introduce pressurized fluid, for example oil, from the pump and into the hydraulic cylinders 15 of hammer 20. Operator controls for movement of hydraulic cylinders 15 and/or hammer 20 may be located within a cabin 11 of machine 10.

As shown in FIG. 1, hammer 20 may include an outer shell 30 and an actuator assembly 32 located within outer shell 30. Outer shell 30 may connect actuator assembly 32 to stick 16 and provide protection for actuator assembly 32. A work tool 25 may be operatively connected to an end of actuator assembly 32 opposite stick 16. It is contemplated that work tool 25 may include any known tool capable of interacting with hammer 20. In one embodiment, work tool 25 includes a chisel bit.

Figure 2:
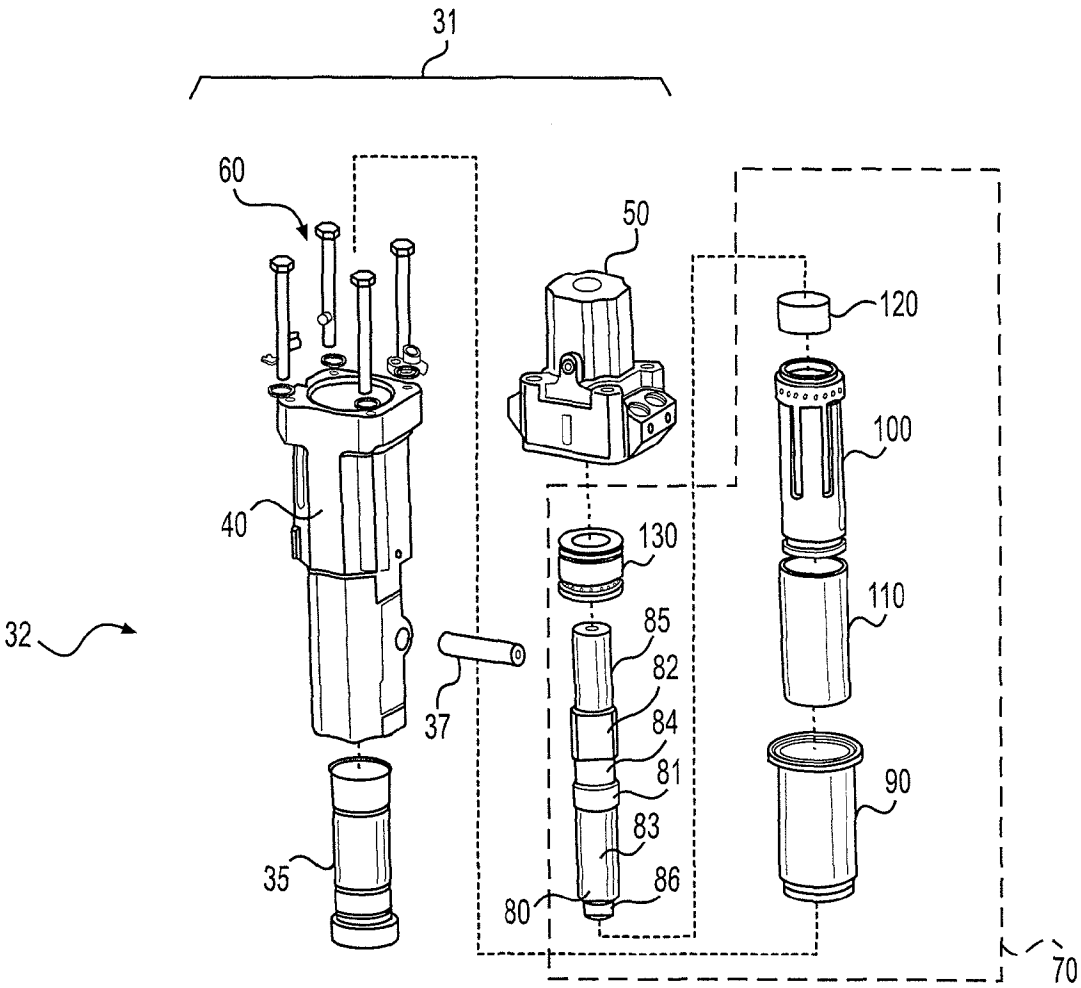
FIG. 2 is an exploded view of an exemplary disclosed hydraulic hammer assembly that may be used with the machine of FIG. 1.

As shown in FIG. 2, actuator assembly 32 may include a subhousing 31, a bushing 35, and an impact system 70. Subhousing 31 may include, among other things, a frame 40 and a head 50. Frame 40 may be a hollow cylindrical body having one or more flanges or steps along its axial length. Head 50 may cap off one end of frame 40. Specifically, one or more flanges on head 50 may couple with one or more flanges on frame 40 to provide a sealing engagement. One or more fastening mechanisms 60 may rigidly attach head 50 to frame 40. In some embodiments, fastening mechanism 60 may include, for example, screws, nuts, bolts, or any other means capable of securing the two components. Frame 40 and head 50 may each include holes to receive fastening mechanism 60.

Bushing 35 may be disposed within a tool end of subhousing 31 and may be configured to connect work tool 25 to impact system 70. A pin 37 may connect bushing 35 to work tool 25. When displaced by hammer 20, work tool 25 may be configured to move a predetermined axial distance within bushing 35.

Impact system 70 may be disposed within an actuator end of subhousing 31 and be configured to move work tool 25 when supplied with pressurized fluid. As shown by the dotted lines in FIG. 2, impact system 70 may be an assembly including a piston 80, an accumulator membrane 90, a sleeve 100, a sleeve liner 110, a valve 120, and a seal carrier 130. Sleeve liner 110 may be assembled within accumulator membrane 90, sleeve 100 may be assembled within sleeve liner 110, and piston 80 may be assembled within sleeve 100. All of these components may be generally co-axial with each other. Valve 120 may be assembled over an end of piston 80 and may be located radially inward of both sleeve 100 and seal carrier 130. A portion of seal carrier 130 may axially overlap with sleeve 100. Additionally, valve 120 may be disposed axially external to accumulator membrane 90. Valve 120 and seal carrier 130 may be located entirely within head 50. Accumulator membrane 90, sleeve 100, and sleeve liner 110 may be located within frame 40. Head 50 may be configured to close off an end of sleeve 100 when connected to frame 40. Furthermore, piston 80 may be configured to slide within both frame 40 and head 50 during operation.

Piston 80 may be configured to reciprocate within frame 40 and contact an end of work tool 25. In the disclosed embodiment, piston 80 is a metal cylindrical rod (e.g. a steel rod) approximately 20.0 inches in length. Piston 80 may comprise varying diameters along its length, for example one or more narrow diameter sections disposed axially between wider diameter sections. In the disclosed embodiment, piston 80 includes three narrow diameter sections 83, 84, 85, separated by two wide diameter sections 81, 82. Narrow diameter sections 83, 84, 85 may cooperate with sleeve 100 to selectively open and close fluid pathways within sleeve 100.

Narrow diameter sections 83, 84, 85, may comprise axial lengths sufficient to facilitate fluid communication with accumulator membrane 90. In one embodiment, narrow diameter sections 83, 84, 85 may comprise lengths of approximately 6.3 inches, 2.2 inches, and 5.5 inches, respectively. Additionally, narrow diameter sections 83, 84, 85 may each comprise a diameter suitable to selectively open and close the fluid pathways in sleeve 100, for example diameters of approximately 2.7 inches. Wide diameter sections 81, 82, in one embodiment, may each comprise a diameter of approximately 3.0 inches and be configured to slideably engage an inner surface of sleeve 100. However, in other embodiments, any desired dimensions may be used.

Piston 80 may further include an impact end 86 having a smaller diameter than any of narrow diameter sections 83, 84, 85. Impact end 86, may be configured to contact work tool 25 within bushing 35. In one embodiment, impact end 86 may comprise an axial length of approximately 1.5 inches. However, in other embodiments, any desired dimensions may be used.

Figure 3:
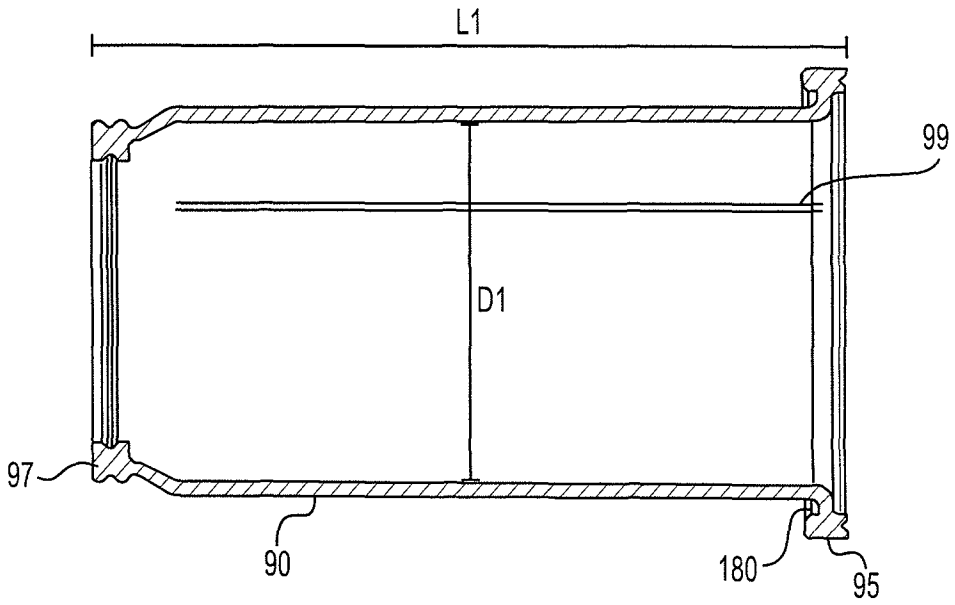
FIG. 3 is a cross-sectional illustration of an exemplary disclosed accumulator membrane that may be used with the hydraulic hammer of FIG. 2.

Accumulator membrane 90 may form a cylindrical tube configured to hold a sufficient amount of pressurized fluid for hammer 20 to drive piston 80 through at least one stroke. In one embodiment, accumulator membrane 90 may extend approximately one-half an axial length of piston 80. As shown in FIG. 3, accumulator membrane 90 may have an axial length L1 of approximately 10.0 inches and an internal diameter D1 of approximately 4.8 inches. Additionally, accumulator membrane 90 may form a volume of 0.3 liters in an annular space 170 between accumulator membrane 90 and sleeve 100. However, in other embodiments, any desired dimensions may be used for accumulator membrane 90. An extension 97 may be formed at one end (i.e. near work tool 25) of accumulator membrane 90. Extension 97 may be disposed co-axial with piston 80 and oriented inwards towards piston 80. A lip 95 may be formed at an opposite end (i.e. near valve 120) of accumulator membrane 90, and may extend backward over a portion of accumulator membrane 90 to create an outer annular pocket 180 or channel. A rib 99 may extend from extension 97 to lip 95, as shown in FIG. 3. Accumulator membrane 90 may be made from a material sufficient for pressurized gas within pocket 180 to selectively compress accumulator membrane 90 inward toward piston 80. In one embodiment, accumulator membrane 90 may comprise an elastic material, for example synthetic rubber. Specifically, the material may comprise a 70 durometer rubber. In other embodiments, accumulator membrane 90 may comprise any suitable material.

Sleeve 100 may form a cylindrical tube having an axial length longer than an axial length of accumulator membrane 90. Sleeve 100 may include a first end 101, located near work tool 25, and a second end 102, located further from work tool 25. A recess 109 may be formed in sleeve 100 at first end 101. In one embodiment, sleeve 100 may have a length of approximately 13 inches. However, in other embodiments, any desired length may be used. One or more fluid passages may be formed within sleeve 100 that extend between piston 80 and accumulator membrane 90. Movement of piston 80 (i.e., of narrow diameter sections 83, 84, 85 and wide diameter sections 81, 82) may selectively open or close these passages. During assembly, sleeve 100 may be configured to slide over a bottom portion of narrow diameter section 83 of piston 80 and sealingly engage wide diameter section 82.

Figure 4:
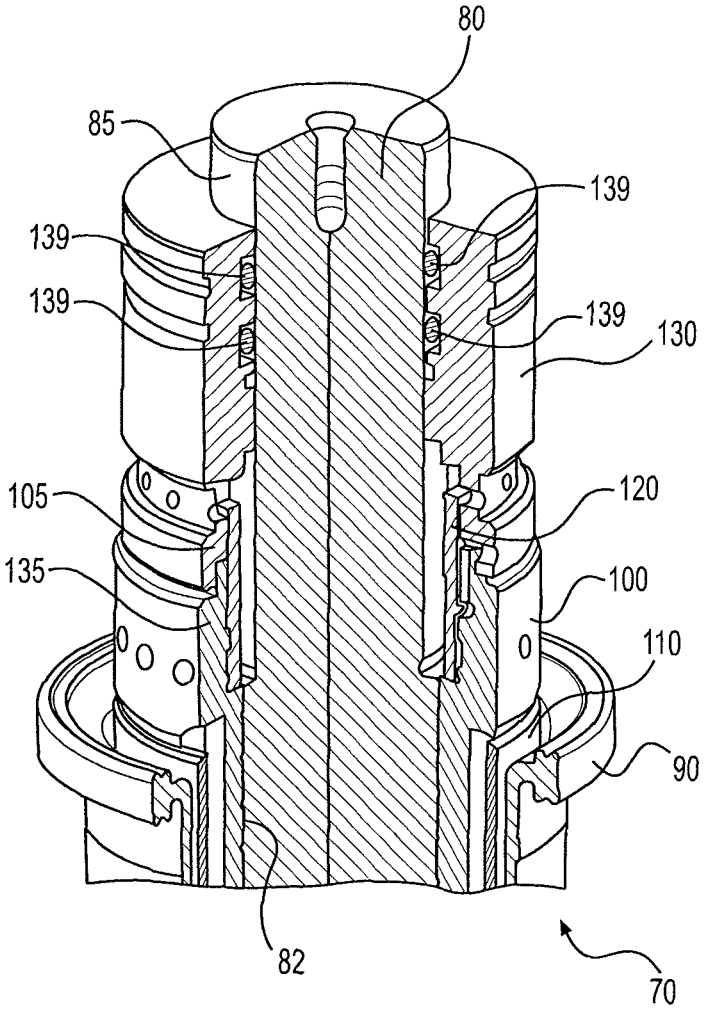
FIGS. 4 and 5 are cross-sectional illustrations of an exemplary impact system that may be used with the hydraulic hammer of FIG. 2.

Valve 120 may include a tubular member located external to and at an axial end of accumulator membrane 90. Valve 120 may be disposed around piston 80 at narrow diameter section 85, and radially inward of sleeve 100, between sleeve 100 and piston 80. As shown in FIG. 4, valve 120 may be located inward of both sleeve 100 and seal carrier 130 such that sleeve 100 surrounds a bottom portion of valve 120 (i.e., a portion closer to lip 95) and seal carrier 130 surrounds a top portion of valve 120 (i.e., a portion opposite lip 95). A cavity 123 may be formed between sleeve 100 and piston 80 and between seal carrier 130 and piston 80. Sleeve 100 and seal carrier 130 may overlap each other to form cavity 123. Valve 120 may be disposed within cavity 123.

As shown in FIG. 4, piston 80, sleeve 100, valve 120, and seal carrier 130 may be held together as a sub-assembly by way of slip-fit radial tolerances. For example, slip-fit radial tolerances may be formed between sleeve 100 and piston 80 and between seal carrier 130 and piston 80. Sleeve 100 may apply an inward radial pressure on piston 80, and seal carrier 130 may apply an inward radial pressure on piston 80. Such may hold sleeve 100, seal carrier 130, and piston 80 together, and may hold valve 120 within cavity 123 (FIG. 4).

Figure 5:
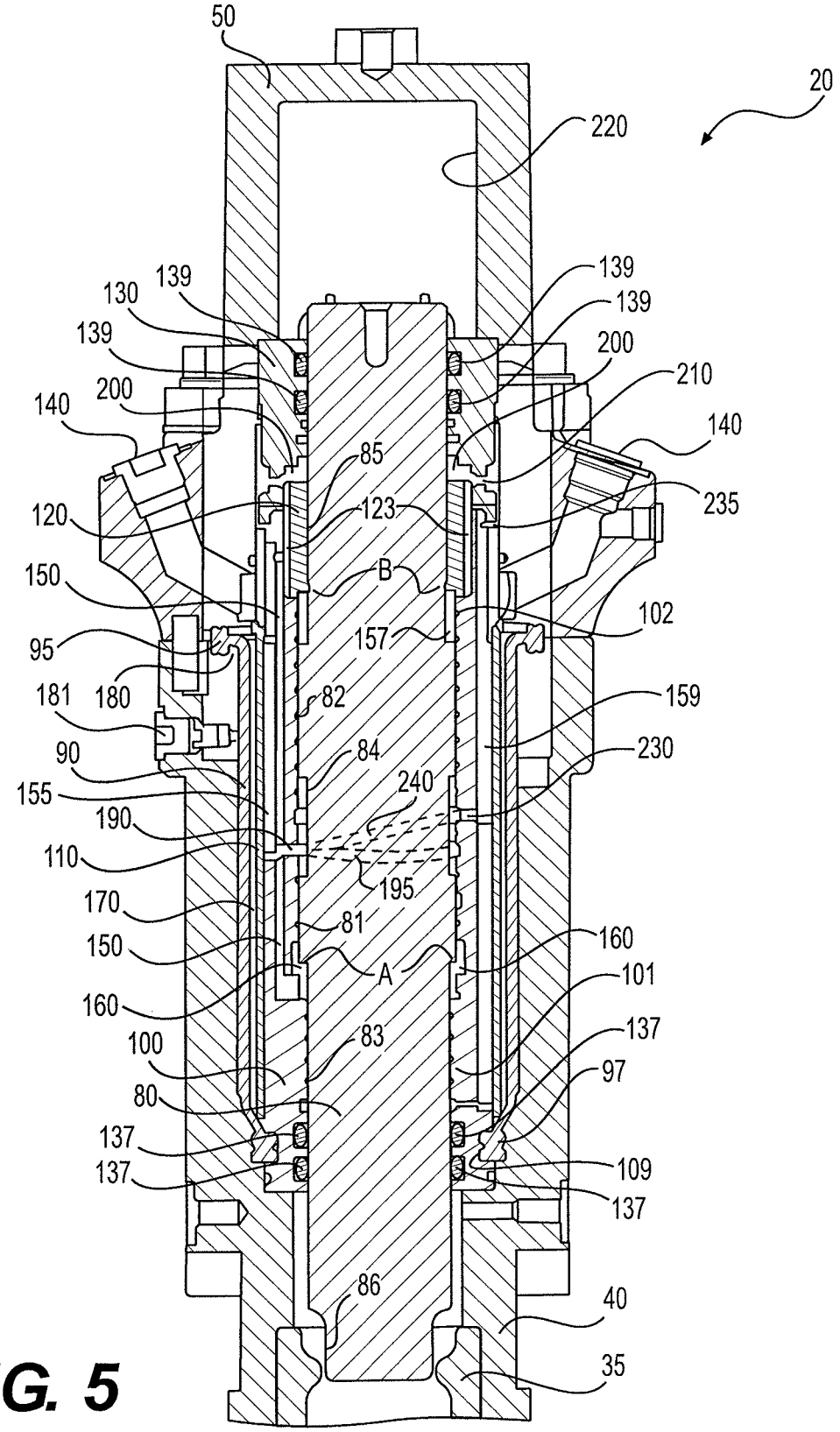

A first seal 137 and a second seal 139 may additionally secure the sub-assembly so that it remains assembled when removed from frame 40. First seal 137 may include one or more U-cup seals or O-rings disposed between sleeve 100 and piston 80. As shown in FIG. 5, first seal 137 may be compressed during assembly to generate a radial force on sleeve 100 and piston 80 after assembly that secures sleeve 100 to piston 80. Second seal 139 may include one or more U-cup seals or O-rings disposed between seal carrier 130 and piston 80. As also shown in FIG. 5, second seal 139 may be compressed during assembly to generate a radial force on seal carrier 130 and piston 80 after assembly that secures seal carrier 130 to piston 80. First and second seals 137, 139 may secure the sub-assembly such that valve 120 is trapped within cavity 123. Valve 120 may be configured to move up and down within cavity 123.

Sleeve 100 and seal carrier 130 may additionally be secured together with a coupling including a slip fit, interference, or any other coupling known in the art. For example, seal carrier 130 may include a female connector 105 received by a male connector 135 on sleeve 100. The female and male connectors 105,135, of the coupling, may secure seal carrier 130 with sleeve 100 and thereby also secure valve 120 against piston 80.

Accumulator membrane 90 may be connected with sleeve 100 through an interference coupling. Specifically, extension 97 of accumulator membrane 90 may be received within recess 109 of sleeve 100 to couple accumulator membrane 90 with sleeve 100. This connection may further hold impact system 70 together when impact system 70 is removed from frame 40.

As also shown in FIGS. 4 and 5, impact system 70 may include a plurality of longitudinal recesses 150, 155, 157, 159 configured to direct fluid within hammer 20 to move piston 80. First, second, and fourth longitudinal recesses 150, 155, 159, respectively, may be formed as grooves and/or slots within sleeve 100, and third longitudinal recess 157 may be formed as a groove/slot disposed between valve 120 and piston 80. An inlet 140 may be formed within head 50 and extend inward to communicate with the plurality of longitudinal recesses 150, 155, 157, 159. The grooves and/or slots may be of sufficient size for the fluid to be drawn from inlet 140 down toward bushing 35, within sleeve 100, by a gravitational force.

One or more first longitudinal recesses 150 may fluidly connect inlet 140 with an annular groove 160 formed at an internal surface of sleeve 100. Annular groove 160 may be formed as a concentrically arranged passage around piston 80 With this configuration, fluid may flow from inlet 140, through first longitudinal recesses 150, into annular groove 160, and into contact with a shoulder A at wide diameter section 81 of piston 80.

Inlet 140 may additionally communicate with an annular space 170 that exists between accumulator membrane 90 and sleeve liner 110. Pressurized gas selectively introduced into pocket 180 via gas inlet 181 may apply inward pressure to accumulator membrane 90 and affect the size of annular space 170. That is, as shown in FIG. 5, accumulator membrane 90 may be radially spaced apart from sleeve 100 when accumulator membrane 90 is in a relaxed state (i.e. not under pressure from the gas). For example, accumulator membrane 90 may be spaced approximately 8.0 mm from sleeve 100 when in the relaxed state. Fluid may flow within annular space 170 when accumulator membrane 90 is in the relaxed state. However, when accumulator membrane 90 is under pressure from the pressurized gas, no spacing may exist between accumulator membrane 90 and sleeve 100, and fluid flow therebetween may be inhibited.

A plurality of radial passages 190 may be concentrically formed within an annular wall of sleeve 100 and connect to a first annular ring 195, formed as a concentrically arranged passage around piston 80. First annular ring 195 may fluidly connect radial passages 190 with recesses 150, 155, 157, 159 for movement of fluid to and from recesses 150, 155, 157, 159. Additionally, radial passages 190 may be disposed below valve 120, for example between seal carrier 130 and annular groove 160.

At least one of the first longitudinal recesses 150 may fluidly connect to at least one of the plurality of radial passages 190, such that first longitudinal recesses 150 may fluidly connect radial passages 190 with accumulator membrane 90. This connection may be an indirect connection, around an end of sleeve liner 110. Additionally, first longitudinal recesses 150 may fluidly connect annular groove 160 with accumulator membrane 90 via radial passages 190. Radial passages 190 may be disposed above annular groove 160 such that annular groove 160 is disposed between impact end 86 of piston 80 and radial passages 190.

Each of the plurality of radial passages 190 may further connect first longitudinal recesses 150 to valve 120 via second longitudinal recess 155. As shown in FIG. 5, each of the plurality of radial passages 190 may connect first longitudinal recesses 150 with second longitudinal recess 155. Therefore, when radial passages 190 are open (i.e. upon movement of wide diameter section 81 of piston 80 toward valve 120), fluid may flow from first longitudinal recesses 150, through radial passages 190, and into second longitudinal recess 155. Additionally, fluid within annular groove 160 may flow within first longitudinal recesses 150 toward valve 120, through radial passages 190 and into second longitudinal recess 155. Second longitudinal recess 155 may direct the fluid toward valve 120 and selectively open a fluid chamber 200 via a third longitudinal recess 157.

Fluid chamber 200 may be formed within head 50 and located axially adjacent to a a base end of valve 120. Therefore, valve 120 may be located between fluid chamber 200 and radial passages 190. Additionally, fluid chamber 200 may be formed at least partially within seal carrier 130 and co-axial to piston 80. Third longitudinal recess 157 may selectively connect inlet 140 with fluid chamber 200 and be disposed between valve 120 and piston 80.

A plurality of outlet apertures 210 may be formed within seal carrier 130 and fluidly connected with fluid chamber 200. Therefore, outlet apertures 210 may be fluidly connected with radial passages 190 via recesses 150, 157 and fluid chamber 200. Fluid may be selectively released from fluid chamber 200 through outlet apertures 210. As shown in FIG. 5, outlet apertures 210 may be disposed external to accumulator membrane 90, between a gas chamber 220 and lip 95 of accumulator membrane 90.

Movement of narrow diameter section 84 of piston 80 may selectively connect radial passages 190 with an outlet passage 230 via a second annular ring 240. Outlet passage 230 may be disposed external to valve 120. As shown in FIG. 5, second longitudinal recess 155 may be selectively connected to radial passages 190, second annular ring 240, and outlet passage 230 to release fluid within second longitudinal recess 155 from hammer 20. Fourth longitudinal recess 159 may fluidly connect outlet passage 230 with outlet 235. As also shown in FIG. 5, outlet 235 may include one or more apertures formed through sleeve 100 and disposed between fluid chamber 200 and lip 95 of accumulator membrane 90.

FIG. 5 further illustrates gas chamber 220 disposed within head 50 at an end of piston 80 opposite bushing 35. Gas chamber 220 may be located axially adjacent to fluid chamber 200, and may be configured to contain a compressible gas, for example nitrogen gas. Piston 80 may be slideably moveable within gas chamber 220 to increase and decrease the size of gas chamber 220. A decrease in size of gas chamber 220 may increase the gas pressure within gas chamber 220.

FIGS. 6, 7, 8, and 9 illustrate operation of hammer 20 during different operational steps of piston 80. FIGS. 6, 7, 8, and 9 will be described in more detail below to further illustrate the disclosed concepts.

INDUSTRIAL APPLICABILITY

The disclosed hydraulic hammer may have increased efficiency from traditional hammers. Specifically, the hydraulic hammer may include shorter fluid paths between an associated piston and accumulator membrane 90 such that fluid flow within the hammer may be faster. This may correspondingly result in faster movement of the piston and a work tool. Operation of hammer 20 will now be described in detail.

As illustrated in FIGS. 4 and 5, hammer 20 may receive pressurized fluid, for example pressurized oil, at inlet 140. The oil may flow down inlet 140 and be directed axially into accumulator membrane 90. The oil may flow into the one or more first longitudinal recesses 150 and be drawn by force of pressure axially downward toward a tip of piston 80 (i.e. toward impact end 86). Additionally, oil from inlet 140 may be directed axially into annular space 170, within accumulator membrane 90, substantially simultaneously as it is directed into first longitudinal recesses 150.

The oil within annular space 170 may apply an outward pressure on pocket 180. Pressurized gas within pocket 180 may apply an inward pressure on annular space 170, thereby creating a spring-like action between pocket 180 and annular space 170. This spring-like action may drive oil from annular space 170 into first longitudinal recesses 150, when the pressure within first longitudinal recess 150 drops.

Figure 6:
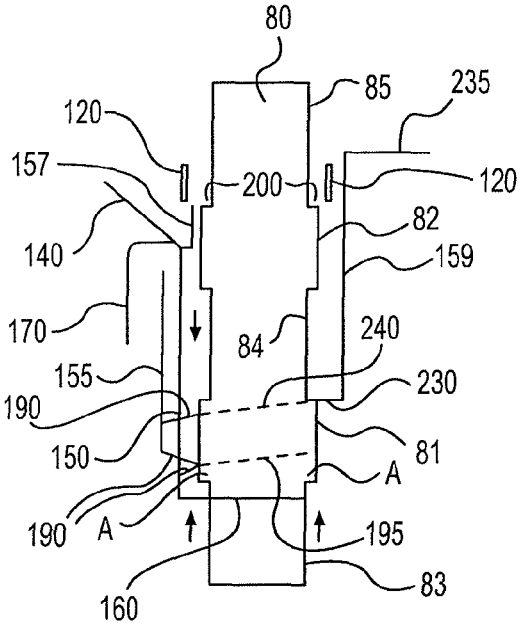
FIGS. 6, 7, 8, and 9 are schematic illustrations of the impact system of FIGS. 4 and 5.

First longitudinal recesses 150 may direct the oil axially downward, within sleeve 100, toward annular groove 160. As shown in FIG. 6, annular groove 160 may redirect the oil radially inward from accumulator membrane 90 and toward piston 80. A sufficient amount of oil within annular groove 160 may apply an upward pressure on piston 80. Specifically, the oil within annular groove 160 may apply pressure to a shoulder A of wide diameter section 81 and bias piston 80 upward toward valve 120.

Figure 7:
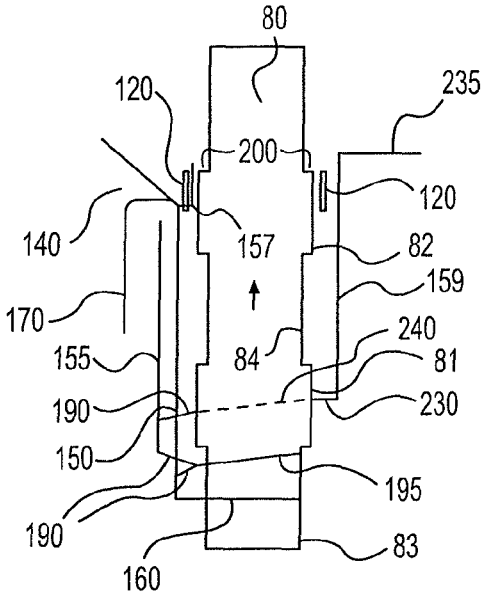

Movement of piston 80 upward toward valve 120 may selectively open the plurality of radial passages 190. Before upward movement of piston 80, radial passages 190 may be blocked by wide diameter section 81. Specifically, as shown in FIG. 7, movement of piston 80 upward may correspondingly move narrow diameter section 83 to a location adjacent to radial passages 190. The smaller diameter of narrow diameter section 81 may open radial passages 190 and allow fluid flow from first longitudinal recesses 150, through radial passages 190, and into second longitudinal recess 155. Therefore, the oil may be directed from first longitudinal recesses 150 and radially inward into first annular ring 195, by way of radial passages 190. The oil within first annular ring 195 may be directed radially outward to second longitudinal recess 155 by way of radial passages 190. Additionally, an amount of oil may be directed from annular groove 160, into first longitudinal recesses 150, and into radial passages 190. This oil is also further directed into second longitudinal recess 155, via first annular ring 195, and toward valve 120. The oil within second longitudinal recess 155 may be less pressurized than the oil within first longitudinal recess 150 due to the movement of oil through the plurality of radial passages 190.

Movement of piston 80 may selectively block and pass the oil to valve 120. For example, movement of piston 80 upward toward valve 120 may also cause wide diameter section 82 to move from a location axially distance and remote from valve 120 to a location wherein wide diameter section 82 is adjacent and internal to valve 120. Third longitudinal recess 157 may be located between valve 120 and wide diameter section 82 due to such movement of piston 80.

Figure 8:
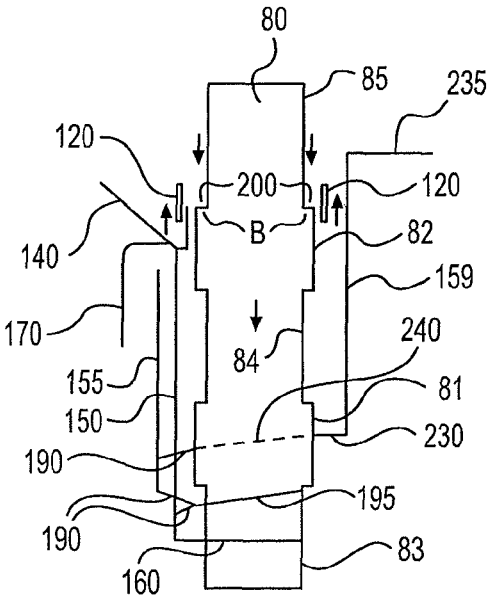

Second longitudinal passage 155, as shown in FIG. 8, may direct the oil axially away from the tip of piston 80 and to valve 120. Oil within second longitudinal passage 155 may apply an upward pressure to an end of valve 120 and bias valve 120 upward toward fluid chamber 200. Movement of valve 120 upward may connect third longitudinal passage 157 with inlet 140. The oil may be selectively directed from inlet 140 to fluid chamber 200 through third longitudinal passage 157. The oil within fluid chamber 200 may apply a downward pressure to a shoulder B of wide diameter section 82 and bias piston 80 downward, away from fluid chamber 200. Therefore, piston 80 may accelerate downward toward work tool 25 and contact work tool 25.

Movement of piston 80 toward valve 120 may also cause narrow diameter section 85 to reduce the size of gas chamber 220 (FIG. 5). This reduction in size may further pressurize nitrogen gas within gas chamber 220, thereby biasing piston 80 downward and away from valve 120. Such biasing may increase the pressure downward, toward work tool 25, on piston 80.

Figure 9:
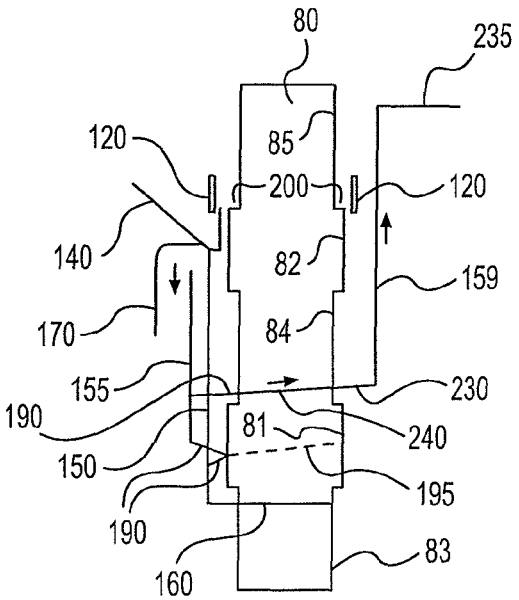

The oil within fluid chamber 200 may be directed radially outward from fluid chamber 200 and through the plurality of outlet apertures 210 such that it is removed from seal carrier 130 (FIG. 5). Additionally, oil within second longitudinal recess 155 may be removed through outlet 235. For example, as shown in FIG. 9, the downward movement of piston 80 may cause narrow diameter section 84 to move from a location distant and remote from radial passages 190 to a position axially adjacent to radial passages 190. Movement of narrow diameter section 84 downward may open second annular ring 240, such that second annular ring 240 may connect radial passages 190 with outlet passage 230. The oil within second longitudinal recess 155 may be directed downward, toward work tool 25, through radial passages 190, and into second annular ring 240. Outlet passage 230 may then redirect the oil radially outward from second annular ring 240 and into fourth longitudinal passage 159. As shown in FIG. 9, fourth longitudinal passage 159 may direct the oil upward, toward gas chamber 220, and into outlet 235 due to a low pressure within fourth longitudinal recess 159. Outlet 235 may direct the oil out of hammer 20.

When hammer 20 is in an off position, rib 99 may provide for the removal of oil from accumulator membrane 90. Pressurized gas within pocket 180 may compress accumulator membrane 90 inward toward piston 80 when hammer 20 is in the off position. This compression may create a seal between accumulator membrane 90 and piston 80, for example a seal sufficient to substantially prevent the passage of fluid. Rib 99 may interpret this seal and may push out an amount of oil within accumulator membrane 90, thus providing for the removal of excess oil.

The present disclosure may provide a hydraulic hammer with shorter fluid passages that may decrease the time required for fluid transfer within the hammer. Shorter fluid passages may be provided between a piston and accumulator membrane, thereby decreasing the time between a piston stroke. This may produce a more efficient hydraulic hammer with reduced aging over time.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A hydraulic hammer assembly, comprising:

a piston;

an accumulator membrane disposed external and co-axial to the piston;

a sleeve disposed between the piston and the accumulator membrane, the sleeve having a plurality of radial passages formed therein that fluidly connect the accumulator membrane with the piston;

a sleeve liner disposed radially between the accumulator membrane and the sleeve;

a plurality of longitudinal recesses formed within the sleeve, wherein at least one of the plural of longitudinal recesses fluidly connects at least one of the plurality of radial passages with the accumulator membrane; and a valve located at an axial end of the accumulator membrane, wherein the plurality of longitudinal recesses connect the valve to at least one of the plurality of radial passages.

2. The hydraulic hammer of claim 1, further including:

a head configured to close off an end of the sleeve; and a fluid chamber formed within the head.

3. The hydraulic hammer of claim 2, wherein the valve is located inward of the sleeve and between the fluid chamber and the plurality of radial passages.

4. The hydraulic hammer of claim 3, further including:

a seal carrier co-axial with and located axially adjacent to the valve; and a plurality of outlet apertures formed within the seal carrier, wherein the plurality of longitudinal recesses connects the plurality of outlet apertures with at least one of the plurality of radial passages.

5. The hydraulic hammer of claim 1, wherein the piston includes a narrow diameter section located axially between wider diameter sections, the wider diameter sections configured to engage an internal surface of the sleeve.

6. The hydraulic hammer of claim 5, further including an outlet passage disposed external to the valve, wherein movement of the narrow diameter section fluidly connects the plurality of radial passages with the outlet passage.

* * * * *